US008355237B2

(12) United States Patent
Kotsuji et al.

(10) Patent No.: US 8,355,237 B2
(45) Date of Patent: Jan. 15, 2013

(54) ION GENERATOR

(75) Inventors: Kazuo Kotsuji, Koganei (JP); Kazuyoshi Onezawa, Koganei (JP); Yoshinari Fukada, Koganei (JP); Akira Goto, Tome (JP)

(73) Assignee: Koganei Corporation, Tokyo (JP)

( * ) Notice: Subject to any disclaimer, the term of this patent is extended or adjusted under 35 U.S.C. 154(b) by 209 days.

(21) Appl. No.: 13/026,674

(22) Filed: Feb. 14, 2011

(65) Prior Publication Data

US 2011/0199714 A1 Aug. 18, 2011

(30) Foreign Application Priority Data

Feb. 17, 2010 (JP) ..... 2010-32348

(51) Int. Cl.
*H01T 23/00* (2006.01)

(52) U.S. Cl. ..... 361/230; 361/231

(58) Field of Classification Search ..... 361/220, 361/230, 231

See application file for complete search history.

(56) References Cited

U.S. PATENT DOCUMENTS

| | | | | |
|---|---|---|---|---|
| 7,695,552 | B2 | 4/2010 | Sato et al. | |
| 2006/0232908 | A1 * | 10/2006 | Izumi et al. | 361/220 |
| 2008/0190294 | A1 * | 8/2008 | Sato et al. | 96/63 |

FOREIGN PATENT DOCUMENTS

| | | | |
|---|---|---|---|
| JP | 2004228069 | A | 8/2004 |
| JP | 2004362951 | A | 12/2004 |
| JP | 2006100248 | A | 4/2006 |
| JP | 2008198533 | A | 8/2008 |

* cited by examiner

*Primary Examiner* — Danny Nguyen
(74) *Attorney, Agent, or Firm* — McCormick, Paulding & Huber LLP

(57) ABSTRACT

A maintenance operation of an ion generator can be easily performed. A device main body has an inner case and an outer case, and the inner case having a support block and an air supply pipe is inserted into the outer case. An opposite electrode is detachably mounted in the support block from a front side of the device main body, and a discharge needle unit is detachably mounted from a reversed direction thereto. The discharge needle unit has a holder, in which the discharge electrode is provided, and a sleeve, which forms an ion generating space between the opposite electrode and the sleeve, is detachably mounted in the holder. Air supplied from an outside is supplied to the ion generating space via a flow path in the air supply pipe.

7 Claims, 9 Drawing Sheets

ION GENERATOR

CROSS-REFERENCE TO RELATED APPLICATIONS

Applicant hereby claims foreign priority benefits under U.S.C. §119 from Japanese Patent Application No. 2010-32348 filed on Feb. 17, 2010, the contents of which are incorporated by reference herein.

TECHNICAL FIELD OF THE INVENTION

The present invention relates to an ion generator that sprays, onto a member on which a static electricity to be removed is charged (hereinafter "charged member"), ionized air produced by ionization due to corona discharges.

BACKGROUND OF THE INVENTION

To regard, as a charged member, a charged body on which a static electricity is charged, and to spray ionized air onto the charged member to remove the static electricity from the charged member, an ion generator called also an ionizer or static-electricity-removing device has been used. For example, the ion generator used in manufacture lines of manufacture or assembly of electronic parts has been used, by regarding electronic parts or manufacture assembly jigs etc. as charged members, to remove the static electricity of the charged member that has been charged. By spraying the ionized air on the charged member, it is possible to prevent foreign substances from adhering to the electronic parts etc. due to the static electricity, or the electronic parts from being destroyed or adhering to the jigs due to the static electricity.

The ion generator utilized for use applications as described above has a needle-like discharge electrode, and a cylindrical opposite electrode. The opposite electrode has a through hole that guides air, and constitutes a nozzle that sprays the ionized air onto the charged member, and the discharge electrode is disposed at a center of a base end portion of the opposite electrode serving as the nozzle. When an AC high voltage is applied between the discharge electrode and the opposite electrode under a state of supplying air to the discharge electrode, corona discharges occur around the discharge electrode, and the supplied air is ionized. The ionized air is sprayed onto the charged member from the nozzle serving as the opposite electrode.

The discharge electrode is not only subjected to abrasion due to air plasmanized by the corona discharges, but also does not avoid adhesion of dust, and once the dust adheres to the discharge electrode, efficiency of ion generation is reduced. For this reason, the discharge electrode is detachably mounted onto an ion generator main body, and by doing maintenance of the discharge electrode periodically, a replacing operation or cleaning operation of the discharge electrode is performed.

As a type of mounting the discharge electrode onto the generator main body, as disclosed in Patent Document 1 (Japanese Patent No. 4170844), there is a type in which a discharge electrode attached to a holder is detached, with respect of a head portion of a main body case, from its back side. The head portion is attached to a nozzle, i.e., an opposite electrode fixed to an attachment bracket. Patent Document 2 (Japanese Patent Application Laid-Open Publication No. 2008-198533) discloses an ionizer in which: an electrode needle cartridge into which a discharge electrode and a high-voltage generator are incorporated is detachably mounted in a main body block; and a nozzle is fixed to the main body block.

Further, Patent Document 3 (Japanese Patent Application Laid-Open Publication No. 2004-362951) discloses an ionizer in which: an air pipe supplying air is connected to a discharge unit provided with a discharge electrode; and an opposite electrode unit is assembled into an ionizer main body in which the discharge unit is detachably mounted. In the ionizers as mentioned in above Patent Documents, the discharge electrode is detached from the back side with respect to the opposite electrode serving as the nozzle.

In contrast, Patent Document 4 (Japanese Patent Application Laid-Open Publication No. 2006-100248) discloses an ionizer of such a type that a holder into which a discharge electrode is press-inserted is incorporated inside a hollow axial-body portion, and that a cylindrical opposite electrode is screwed outside the holder. The discharge electrode and the opposite electrode are detached from a front side.

The discharge electrode is disposed at a center of a base end portion of the opposite electrode serving as the nozzle, and if the discharge electrode is disposed so as to directly oppose the opposite electrode, since the air plasmanized by the corona discharges contacts directly with an inner circumferential surface of the opposite electrode made of a conductive material, the inner circumferential surface of the opposite electrode is subjected to abrasion. For this reason, incorporated into the inner circumferential surface of the opposite electrode is an insulative sleeve made of an insulative material having a plasma-proof property such as ceramic. Since dust adheres also to this inner circumferential surface of the sleeve, the dust adhering to the sleeve needs to be removed periodically.

However, conventionally, there has been a problem in that in the ion generator in form of fixing the sleeve to the nozzle, the discharge and opposite electrodes are each detached from the device main body in order to remove the dust adhering to the discharge electrode and sleeve, whereby a maintenance operation of the ion generator cannot be easily performed. For example, since the electrically insulative sleeve disclosed in Patent Document 2 is fixed to the nozzle, cleaning of the sleeve needs to remove the discharge needle cartridge from the main body block. In addition, although the nozzles different in shape according to a kind of the charged member are often mounted to the same ion generator at a time of maintenance, when the sleeve is incorporated inside the nozzle serving as the opposite electrode, the sleeve needs to be provided to each of a plurality of kinds of nozzles, and replacement of the nozzle only cannot be made.

An object of the present invention is to be able to detach simply a sleeve, which is disposed between a discharge electrode and an opposite electrode and made of an insulative material, and which can easily perform a maintenance operation of an ion generator.

An object of the present invention is to be able to replace easily the opposite electrode without removing the sleeve, and to use selectively the opposite electrodes having various kinds of shapes.

SUMMARY OF THE INVENTION

An ion generator according to the present invention is an ion generator applying, under a state of causing air to flow in between a discharge electrode and an opposite electrode, an AC high voltage to the discharge electrode and the opposite electrode, and generating a corona discharge to ionize the air, the ion generator comprising: a device main body, in which the opposite electrode is mounted so as to protrude forward; and a discharge needle unit including a holder and a sleeve, and detachably mounted into the device main body from a back side of the device main body, the discharge electrode being mounted in the holder so as to protrude from one end portion of the holder, and the sleeve being detachably mounted into one end portion of the holder, being fitted in the opposite electrode, and forming an ion generating space between the discharge electrode and the sleeve, wherein the discharge electrode and the sleeve are detachable from the holder under a state of removing the discharge needle unit from the device main body.

The ion generator according to the present invention is such that the opposite electrode is detachably mounted from a front side of the device main body. The ion generator according to the present invention further comprises a clip pin, which is detachably mounted in the device main body, and is engaged with an engaging groove formed in an outer circumferential surface of the opposite electrode. The ion generator according to the present invention is such that an outer circumferential surface of the holder is provided with an engagement protrusion, and that the device main body is provided with an inserting groove, into which the engagement protrusion is inserted, and an engaging groove, which communicates with the inserting groove and in which the engagement protrusion enters by rotating the holder.

The ion generator according to the present invention is such that an outer circumferential surface of the sleeve is provided with an engagement protrusion, and that the holder is provided with an inserting groove, into which the engagement protrusion is inserted, and an engaging groove, which communicates with the inserting groove and in which the engagement protrusion enters by rotating the sleeve. The ion generator according to the present invention is such that a communication hole, which communicates with an outside, is formed in the device main body, and that a suction port, which sucks exterior air by air sprayed to the ion generating space, is formed in the holder so as to communicate with the communication hole. The ion generator according to the present invention is such that the device main body comprises: an inner case provided with a support block, which supports the discharge needle unit, and with an air supply pipe, which supplies air to the ion generating space from an outside; and an outer case provided with a main body portion, into which the air supply pipe is incorporated, and with a unit receiving portion, which is provided so as to protrude from the main body portion and in which the support block is incorporated.

According to the present invention, the discharge needle unit provided with the discharge electrode, sleeve, and holder is detachably mounted into the device main body, and each of the sleeve and the discharge electrode is detachably mounted into the holder, and the sleeve and the discharge electrode can be easily removed from the holder under the state of separating the discharge needle unit from the device main body. Therefore, a maintenance operation such as cleaning and replacement regarding the discharge electrode and the sleeve can be easily performed.

Since the opposite electrode can be separated from the sleeve, the maintenance operation such as cleaning and replacement regarding only the opposite electrode can be easily performed, and all of a plurality of kinds of opposite electrodes, in each of which the sleeve is not provided, can be selectively mounted into the support block.

The device main body has: the inner case provided with the support block, which supports the discharge needle unit, and with the air supply pipe, which supplies air to the ion generating space; and the outer case provided with the main body portion, in which the air supply pipe is incorporated, and the unit receiving portion, in which the support block is incorporated. Therefore, by inserting the inner case into the outer case, the device main body can be easily assembled.

DESCRIPTION OF THE PREFERRED EMBODIMENTS

Figure 5:
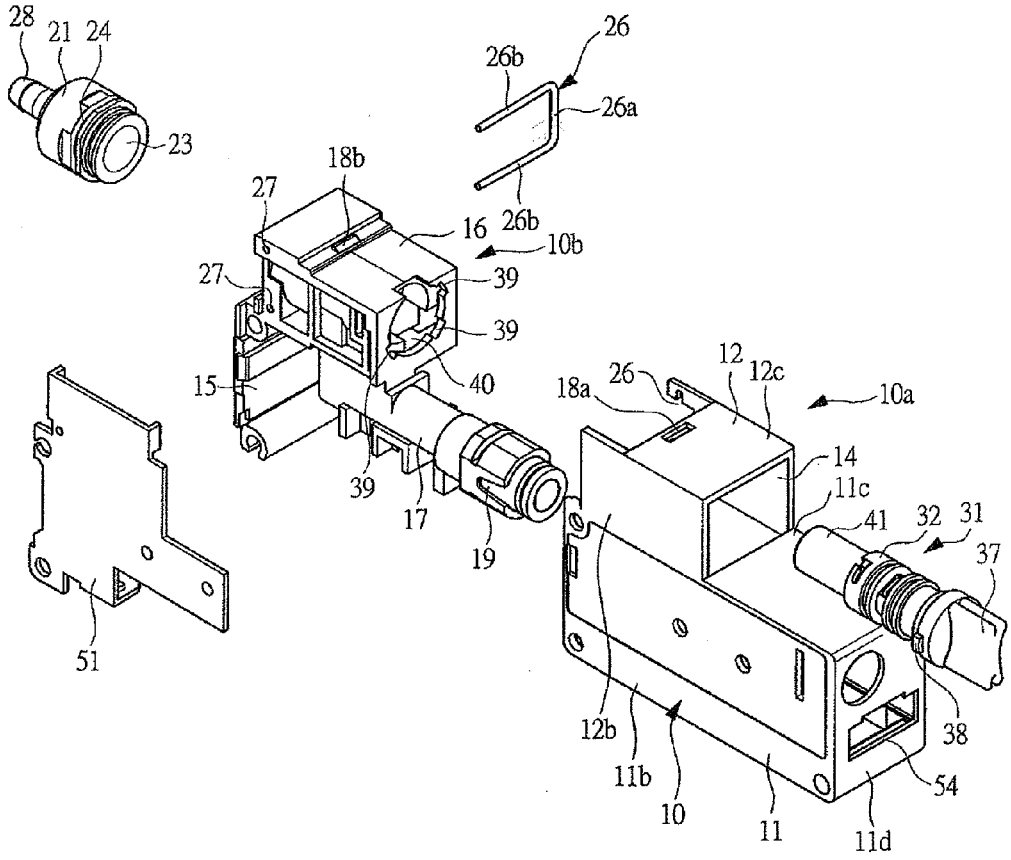
FIG. 5 is an exploded perspective view in which the ion generator is viewed from the back side.
Figure 8:
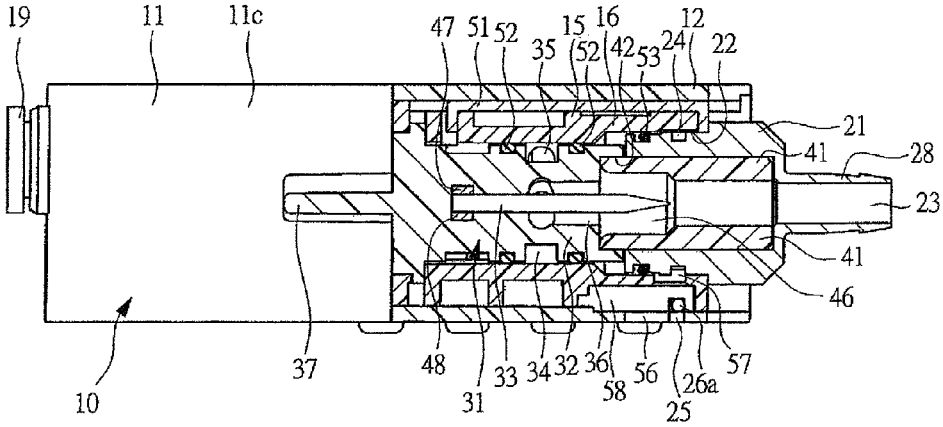
FIG. 8 is a sectional view taken along line 8-8 in FIG. 1.
Figure 10:
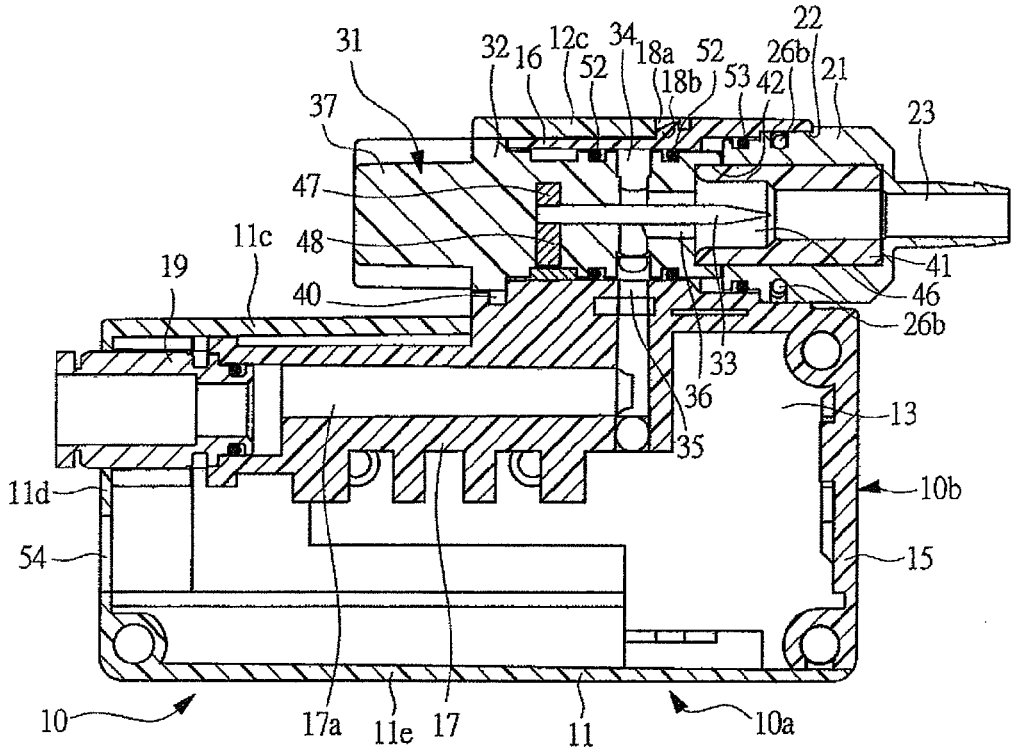
FIG. 10 is a sectional view taken along line 10-10 in FIG. 9.

Hereinafter, embodiments of the present invention will be detailed based on the accompanying drawings. An ion generator has a device main body 10 made of a resin, and the device main body 10 is constituted by a case assembly comprising: an outer case 10*a*; and an inner case 10*b* inserted therein. The outer case 10*a* has a substantially rectangular-parallelepiped-shaped main body portion 11 and a unit receiving portion 12 unitized therewith, and the unit receiving portion 12 is provided so as to protrude upwardly on a front end portion side of the main body portion 11. The main body portion 11 has, as shown in FIGS. 5, 8, and 10, left and right walls 11*a* and 11*b*, a top wall 11*c*, a back wall 11*d*, and a bottom wall 11*e*. An apparatus receiving chamber 13 is formed inside the main body portion 11, and a front end portion of the main body portion is opened. The unit receiving portion 12 has side walls 12*a* and 12*b* continuous with the left and right walls 11*a* and 11*b* of the main body portion 11, and a top wall 12*c*. As shown in FIG. 5, a unit receiving chamber 14 is formed inside the unit receiving portion 12, and its front and back end portions are opened.

As shown in FIG. 5, the inner case 10*b* made of a resin is incorporated into the outer case 10*a*. The inner case 10*b* has a front wall inserted into the front end portion of the main body portion 11 within the outer case 10*a*, a support block 16 assembled into the unit receiving chamber 14 within the unit receiving portion 12, and an air supply pipe 17 assembled into the main body portion 11, and those elements are unitized. When the inner case 10*b* is inserted into the outer case 10*a* from the front side, an engaging claw 18*b* provided to the support block 16 is engaged, as shown in FIGS. 5 and 10, with an engaging hole 18*a* formed in the top wall 12*c* of the unit receiving portion 12. A coupling portion 19 is mounted around the air supply pipe 17, and an end portion of the coupling portion 19 protrudes backward from the main body portion 11 of the outer case 10*a*. A unshown air supply tube connected to an air supply source is detachably mounted in the coupling portion 19, and air is supplied to a flow path 17*a* inside the air supply pipe 17 from an outside.

Mounted in the support block 16 of the inner case 10*b* within the device main body is a hollow opposite electrode 21 made of a conductive material. A fitting hole 22, into which the opposite electrode 21 is fitted, is formed in the support block 16, and the opposite electrode 21 is mounted detachably, i.e., removably in the front end portion of the fitting hole 22 from a front side of the device main body 10. A through hole 23 is formed inside the opposite electrode 21, and the opposite electrode 21 serves as a nozzle that sprays ionized air from its tip to an outside. In the device main body 10 described in the present specification, a portion in which the opposite electrode is mounted is a front portion, i.e., front end portion, and its opposite portion is a back face portion, i.e., a back end portion.

As shown in FIG. 5, an annular engaging groove 24 is formed in an outer circumferential surface of the back end portion of the opposite electrode 21. Meanwhile, as shown in FIG. 3, a pin-inserting opening portion 25 is formed in the unit receiving portion 12 of the device main body 10, and a clip pin 26 is inserted from the pin-inserting opening portion 25.

Figure 3:
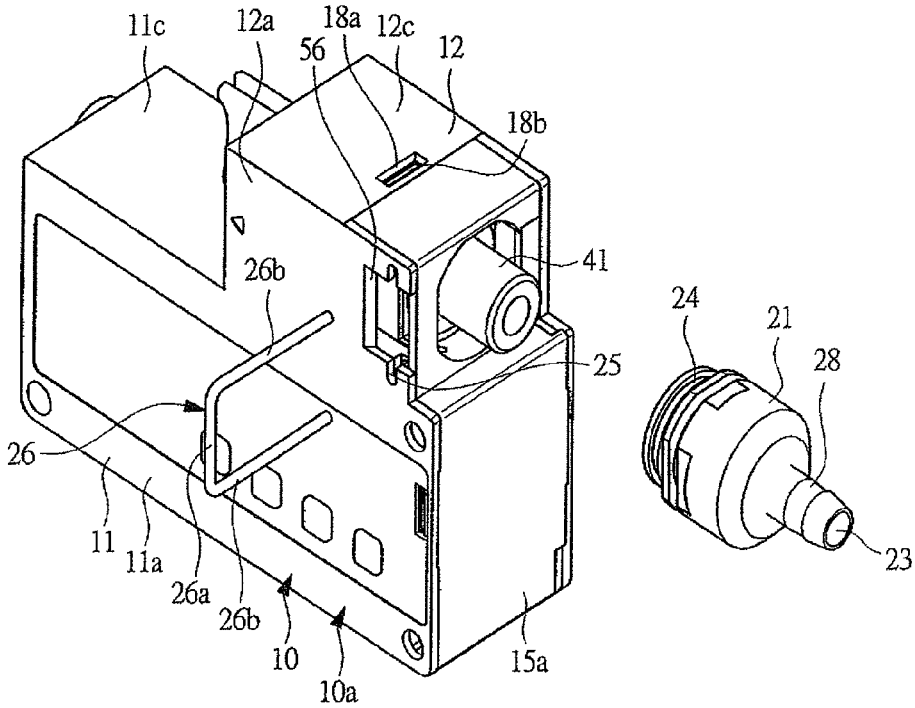
FIG. 3 is a perspective view showing a front side of the ion generator in a state of which a nozzle as an opposite electrode is removed.

The clip pin 26 has, as shown in FIGS. 3 and 5, a coupling portion 26*a*, and two pin main body portions 26*b* extending perpendicularly to the coupling portion 26*a* from its both end portions, and is formed into a reversed C-shape. Pin holes 27 into which the two pin main body portions 26*b* of the clip pin 26 are inserted are formed, as shown in FIG. 5, in the support block 16. When the clip pins 26 are inserted into the pin holes 27 from the pin-inserting opening portion 25, the respective pin main body portions 26*b* are inserted into the pin holes 27 to be engaged with the engaging groove 24 of the opposite electrode 21. Therefore, the opposite electrode 21 is fixed to the support block 16. Meanwhile, when the clip pins 26 are withdrawn and pulled, the opposite electrode 21 can be easily detached from the support block 16 in a direction of the front end portion. Accordingly, if a side of the base end portion of the opposite electrode 21 is made in common, all of a plurality of kinds of opposite electrodes 21 can be selectively mounted into the same device main body 10.

Figure 1:
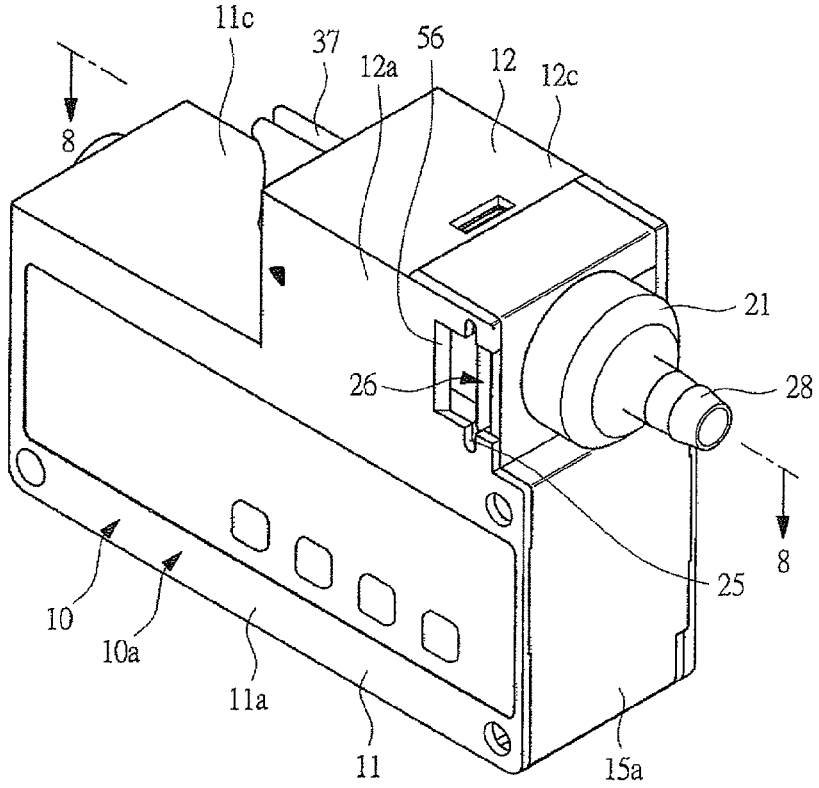
FIG. 1 is a perspective view showing a front side of an ion generator according to an embodiment of the present invention.

Under a state in which the clip pin 26 is attached to the support block 16, as shown in FIG. 1, the coupling portion 26*c* enters the inner case 10*b*, and does not protrude to an outside. Incidentally, although the clip pin 26 is formed into a reversed-C shape having the two pin main body portion 26*b*, the opposite electrode 21 may be fixed to the support block 16 by inserting each of two straight-shaped pins into the pin hole 27. Also, a male screw is formed at the base end portion of the opposite electrode 21, and a female screw is formed in the fitting hole 22, whereby the opposite electrode 21 may be screwed into the support block 16.

Figure 6:
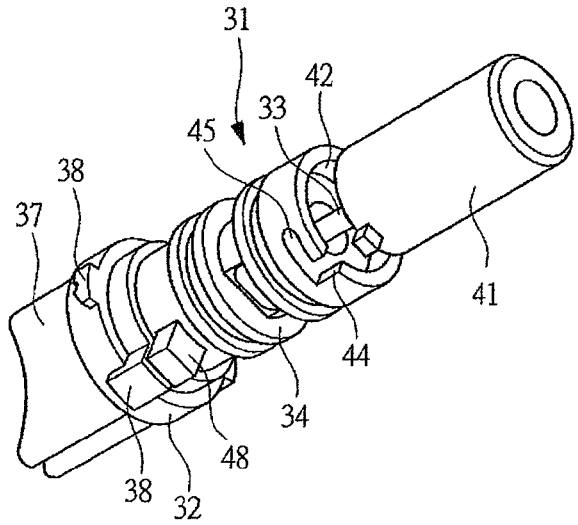
FIG. 6 is a perspective view of the discharge needle unit in a state in which a sleeve is removed from a holder in which a discharge electrode is mounted.
Figure 7:
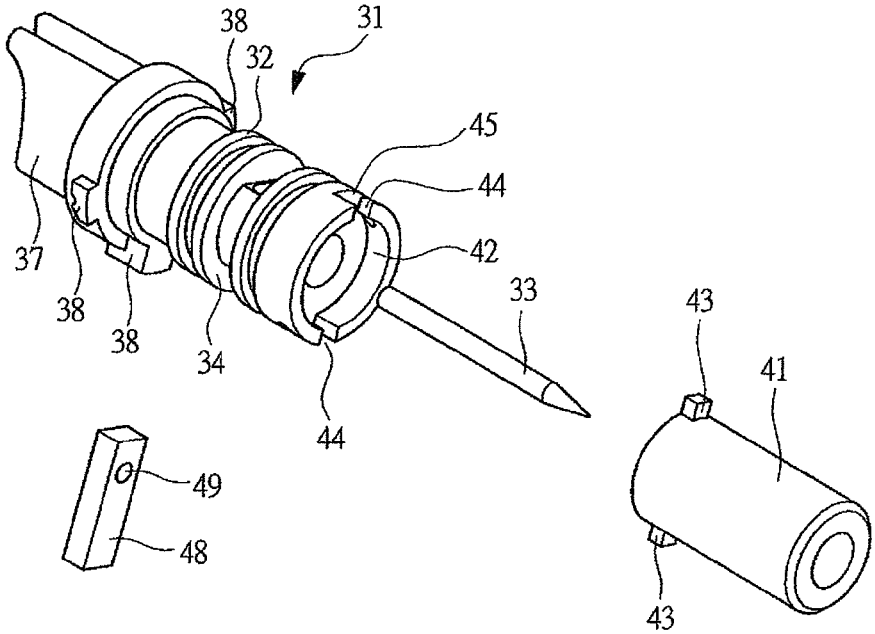
FIG. 7 is an exploded perspective view of the discharge needle unit in a state in which the holder, discharge electrode, and sleeve are separated from one another.

As shown in FIGS. 8 and 10, a discharge needle unit 31 is detachably mounted in the inner case 10*b* of the device main body 10, and the discharge needle unit 31 is fitted to a back end portion side of the fitting hole 22 so as to oppose the opposite electrode 21 and to be coaxial with the opposite electrode 21. The discharge needle unit 31 has, as shown in FIGS. 6 to 8, a substantially cylindrical holder 32, and the holder 32 is formed of an insulative material. Detachably mounted at a center portion of the holder 32 is a needle-shaped discharge electrode 33 made of a conductive material. A tip portion of the discharge electrode 33 mounted into the holder 32 protrudes further ahead from one end face, i.e., a tip face of the holder 32.

As shown in FIGS. 6 and 7, an annular groove 34 is formed in the holder 32, and as shown in FIG. 10, the annular groove 34 communicates with the flow path 17*a* of the air supply pipe 17. A communication hole 35, which causes the annular groove 34 and the flow path 17 to communicate with each other, is formed in support block 16 of the inner case 10*b*, and a spray hole, i.e., an air supply port 36, which communicates with the flow path 17*a* via the communication hole 35 and annular groove 34, is formed in the holder so as to open at a front of the holder 32. By this arrangement, compressed air supplied from an outside via a unshown hose pipe connected to the coupling portion 19 is discharged from the air supply port 36 along the discharge electrode 33 in a front direction. The discharge electrode 33 penetrate a center of the air supply port 36, but a plurality of air supply ports 36 may be provided at radially outward positions rather than the discharge electrode 33.

Figure 4:
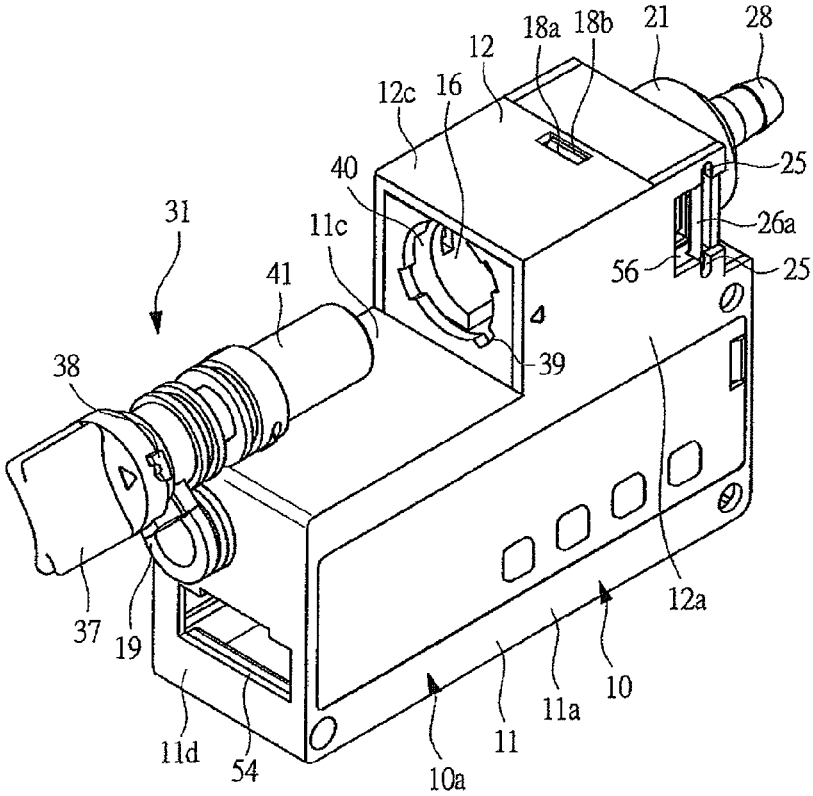
FIG. 4 is a perspective view showing a back side of the ion generator in a state in which a discharge needle unit is removed.
Figure 9:
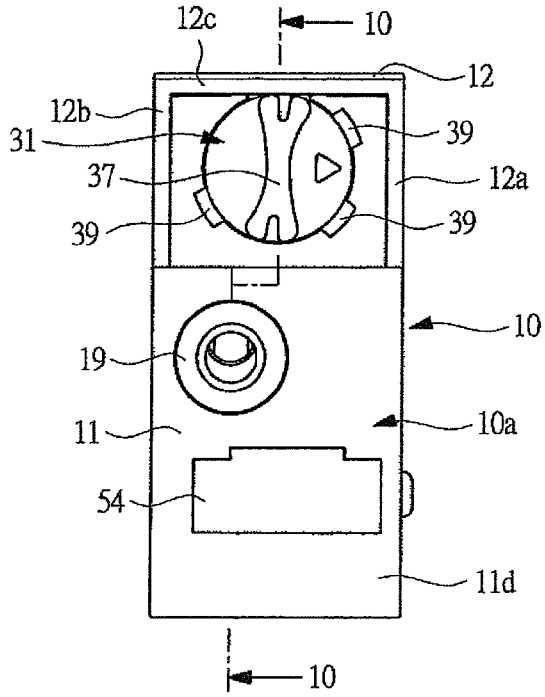
FIG. 9 is a back view of FIG. 1.

A back end portion of the holder 32 is provided with an operational knob 37, and in performing an attaching operation of the discharge needle unit 31 with respect to the support block 16 in the unit receiving portion 12, an operator holds the operational knob 37 in his/her hand to perform an inserting operation and a rotating operation to the discharge needle unit 31. An outer circumferential surface of the back end portion of the holder 32 is provided, as shown in FIGS. 6 and 7, with three engagement protrusions 38 in a circumferential direction in a predetermined interval away from each other. As shown in FIG. 9, three inserting grooves 39 is formed in other end portion, i.e., back end portion of the support block 16 so as to correspond to the respective engagement protrusions 38. When the discharge needle unit 31 is inserted into the support block 16 from a back side of the device main body 10 as shown in FIG. 4, the respective engagement protrusions 38 are inserted into the inserting grooves 39. An engaging groove 40 is formed, as shown in FIG. 5, in the support block 16 so as to communicate with each of the inserting grooves 39, and under s state in which the engagement protrusions 38 are inserted into the inserting grooves 39, when the operational knob 37 is held in the hand to rotate the discharge needle unit 31 in a clockwise direction, the engagement protrusions 38 enter the engaging groove 40, and the discharge needle unit 31 is attached to the support block 16. Meanwhile, when the discharge needle unit 31 is pulled backward after being rotated in a counterclockwise direction, the discharge needle unit 31 can be easily detached from the support block 16.

The operational knob 37 is provided so as to protrude backward from the back end face of the holder 32, but as long as the operational knob has such a structure that the operator can manually rotate the discharge needle unit 31, the operational knob is not limited to the structure as shown in Figures, and the engaging groove, which is engaged with a tool, may be formed in the back end face of the holder 32.

As shown in FIGS. 6 and 7, a cylindrical sleeve 41 is detachably mounted in the front end portion of the holder 32, and the sleeve 41 is formed of an insulative material such as ceramic. A fitting hole 42, in which the sleeve 41 is fitted slidably, is formed in the front end portion of the holder 32, and the sleeve 41 is mounted on the holder 32 so as to protrude from a front end face of the holder. An outer circumferential surface of the back end portion of the sleeve 41 is provided, as shown in FIGS. 6 and 7, with a plurality of engagement protrusions 43 in a predetermined interval away from each other in a circumferential direction, and an inserting grooves 44, in which the respective engagement protrusions 43 are inserted, are formed in the holder 32. Formed in the holder 32 are engaging grooves 45, which communicate with respective inserting grooves 44 and which the engagement protrusions 43 enter. Accordingly, after the sleeve 41 is pushed into the fitting hole 42 of the holder 32 so that the engagement protrusions 43 are inserted into the inserting grooves 44, when the sleeve 41 is rotated in the clockwise direction to cause the engagement protrusions 43 to enter into the engaging grooves 45, the sleeve 41 is mounted on the holder 32. Meanwhile, when the sleeve 41 is rotated in the counterclockwise direction and is pulled, the sleeve 41 can be easily detached from the holder 32.

The discharge needle unit 31, which is constituted by the holder 31, the discharge electrode 33 mounted thereon, and the sleeve 41, is mounted in the support block 16 of the device main body 10 by being inserted from a back side of the support block. In contrast, the opposite electrode 21 is mounted in the support block 16 by being inserted from a front side of the support block. When the opposite electrode 21 and the discharge needle unit 31 are mounted in the support block 16 of the device main body 10, the sleeve 41 is fitted inside the opposite electrode 21 as shown in FIG. 10. Therefore, the discharge electrode 33 becomes in a state of entering inside the back end portion, i.e., the base end portion of the opposite electrode 21, and an ion generating spaced 46 is formed between the discharge electrode 33 and the sleeve 41.

The compressed air from the air supply port 36 formed in the holder 32 is sprayed directly into the ion generating space 46. However, an end wall may be provided to the back end of the sleeve 41, and a hole communicating with the air supply port 36 may be formed in the end wall, whereby the hole may be used as the air supply port. Also, the flow path 17*a* of the air supply pipe 17 may be caused to communicate with the hole formed in the end wall.

The discharge needle unit 31 is removed from the support block 16 toward its back side. When the sleeve 41 is detached from the holder 32 under a state in which the discharge needle unit 31 is detached from the support block 16, the sleeve 41 and the holder 32 are separated from each other, and the tip portion of the discharge electrode 33 is exposed from the front end portion of the holder 32 to an outside. Therefore, when foreign substances such as dust adhering to the discharge electrode 33 is eliminated, since the discharge needle unit 31 is removed, maintenance of the discharge electrode 33 and the sleeve 41 can be easily done without removing the opposite electrode 21.

In the holder 32, a power-feeding electrode 48 is inserted into an attachment hole 47 that is formed so as to extend radially. As shown in FIG. 7, a fitting hole 49, into which the back end portion of the discharge electrode 33 is fitted, is formed in one end portion of the power-feeding electrode 48, and when the discharge electrode 33 is mounted in the holder 32 under a state of inserting the power-feeding electrode 48 into the attachment hole 47, the discharge electrode 33 enters into the attachment hole 47, and the discharge electrode 33 is electrically connected to the power-feeding electrode 48.

The air supply pipe 17, and the support block 16 in which the discharge needle unit 31 is mounted are unitized via the front wall 15 and made of a resin, thereby forming the inner case 10*b*. The inner case 10*b* is assembled inside the outer case 10*a* made of a resin. Accordingly, the discharge needle unit 31 and the opposite electrode 21 become coaxial, and are detachably mounted in the support block 16. By doing so, the ion generator can be easily assembled.

In the main body portion 11 of the outer case 10*a* in the device main body 10, an unshown high-voltage generator is incorporated. One of output terminals of the high-voltage generator is connected to the power-feeding electrode 48. Meanwhile, as shown in FIG. 5, an earth board 51 is mounted on a side face of the support block 16, and under a state in which the earth board 51 is mounted, the support block 16 is inserted into the outer case 10*a*. The earth board 51 contacts with the opposite electrode 21 as shown in FIG. 8, and the other of the output terminals of the high-voltage generator is connected to the earth board 51.

Accordingly, when an AC high voltage is applied to the discharge electrode 33 and opposite electrode 21 from the high-voltage generator under a state in which the compressed air supplied to the air supply pipe 17 from an outside is sprayed into the ion generating space 46 from the air supply port 36, corona discharges occur around the discharge electrode 33 in the ion generating space 46. Therefore, air sprayed from the air supply port 36 is ionized, and is sprayed to an outside from the through hole 23 of the opposite electrode 21 serving as the nozzle. A small-diameter portion 28 is formed at the tip portion of the opposite electrode 21, and an unshown hose pipe is mounted or attached around the small-diameter portion 28. Therefore, the ionized air sprayed from the through hole 23 of the opposite electrode 21 is guided to the charged member by the hose pipe.

Incidentally, as shown in FIG. 10, mounted around an outer circumferential surface of the holder 32 is a seal member 52 that is positioned both sides of the annular groove 34 in order to prevent air flowing in the annular groove 34 from leaking from between the holder 32 and the support block 16 to an outside. Mounted around the outer circumferential surface of the back end portion of the opposite electrode 21 is a seal member 53 for preventing the air from leaking from between the opposite electrode 21 and the support block 16 to the outside. As shown in FIG. 9, an opening portion 54 into which a connector is inserted is formed in the back wall 11*d* of the main body portion 11, and by connecting the connector to a power-feeding plug connected to the high-voltage generator, power is fed to the high-voltage generator from the outside.

As the ion generator is used for long time, the discharge electrode 33 is subjected to abrasion due to the air plasmanized by the corona discharges, and dust in air supplied from the outside adheres to the discharge electrode 33. Meanwhile, dust in air adheres also to the inner circumferential surface of the sleeve 41 made of an insulative material such as ceramic. For those reasons, to clean the discharge electrode 33 and the sleeve 41 or to replace the discharge electrode 33, the ion generator is subjected to maintenance periodically. At this time, the discharge needle unit 31 is detached from the device main body 10 in its back direction. Under this state, when the sleeve 41 is removed from the holder 32, and when the discharge needle unit 31 is separated to the sleeve 41 and the holder 32, since the tip portion of the discharge electrode 33 is exposed to the outside, the foreign substances such as dust adhering to the discharge electrode 33 can be easily eliminated, and the foreign substances adhering to the inner circumferential surface of the sleeve 41 can be easily eliminated. Also, in replacing the discharge electrode 33, the discharge electrode 33 is withdrawn and pulled from the holder 32 in its front direction, whereby the discharge electrode 33 can be easily removed from the holder 32. Thus, maintenance of the discharge electrode 33 and the sleeve 41 can be easily done without removing the opposite electrode 21.

Figure 11:
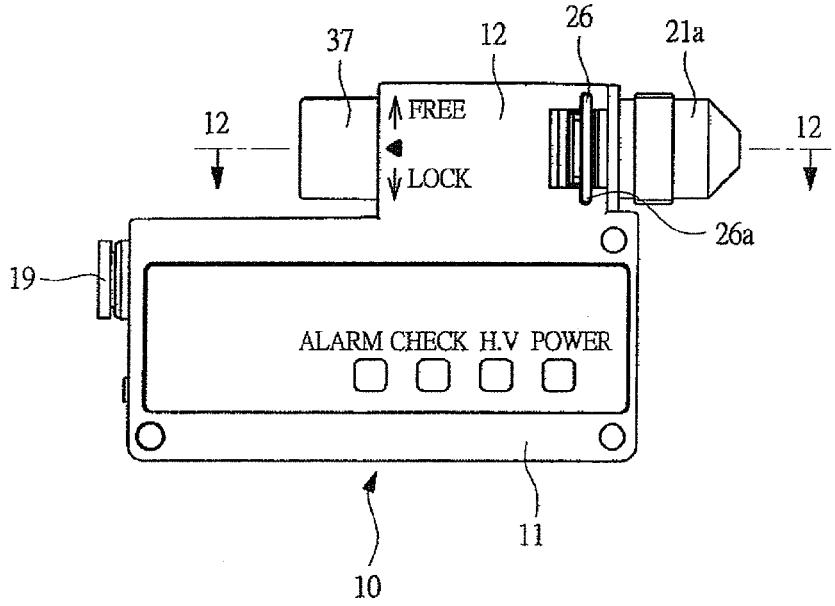
FIG. 11 is a side view showing an ion generator according to another embodiment of the present invention.
Figure 12:
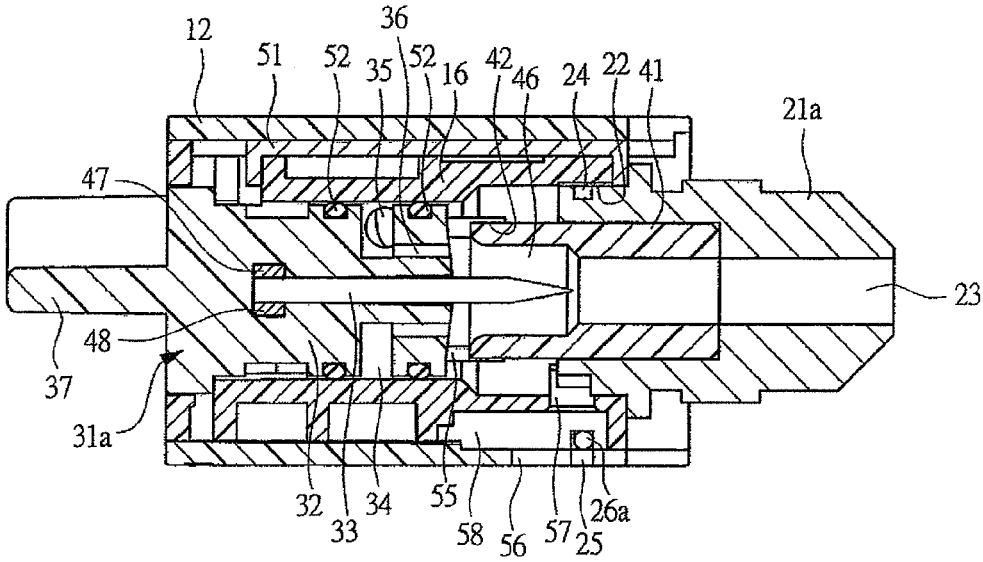
FIG. 12 is a sectional view taken along line 12-12 in FIG. 11.

FIG. 11 is a side view showing an ion generator according to another embodiment of the present invention, and FIG. 12 is a sectional view taken along line 12-12 in FIG. 12. In those Figures, the same reference numerals are denoted to members common to the members constituting the ion generator described above. An opposite electrode 21*a* and a discharge needle unit 31*a* in the ion generator shown in FIGS. 11 and 12 are different from those in the ion generator described above, but other elements in an ion generator shown in FIGS. 11 and 12 are identical to those in the above-mentioned ion generator.

As shown in FIG. 12, a suction port 55 is formed in a tip portion of the holder 32, and the suction port 55 communicates with the ion generating space 46. An air introduction port 56 unitized with the pin-inserting opening portion 25 is formed, as shown in FIG. 12, in the outer case 10*a* in the device main body 10, and a communication hole 57, which causes the air introduction port 56 and the suction port 55 to communicate with each other, is formed in the support block 16 in the inner case 10*b*. For this arrangement, by being sucked in air that is supplied to the ion generating space 46 from the air supply port 36, external air is supplied to the ion generating space 46 via the air introduction hole 56 and communication hole 57 from the outside.

Thus, when air is sucked in and supplied to the ion generating space 46 from the outside, since an amount of exterior air supplied to the ion generating space 46 can be increased without increasing an amount of compressed air supplied to the air supply port 36 from a pneumatic-pressure supply source, even if an amount of air supplied to the air supply port 36 is made small, a large amount of ionized air can be sprayed to the charged member. A filter chamber 58 is formed between the unit receiving portion 12 and the support block 16 so as to cross the air introduction hole 56 and the communication hole 57, and by assembling a filter into the filter chamber, dust in air sucked into the ion generating space 46 from the outside is eliminated.

Figure 2:
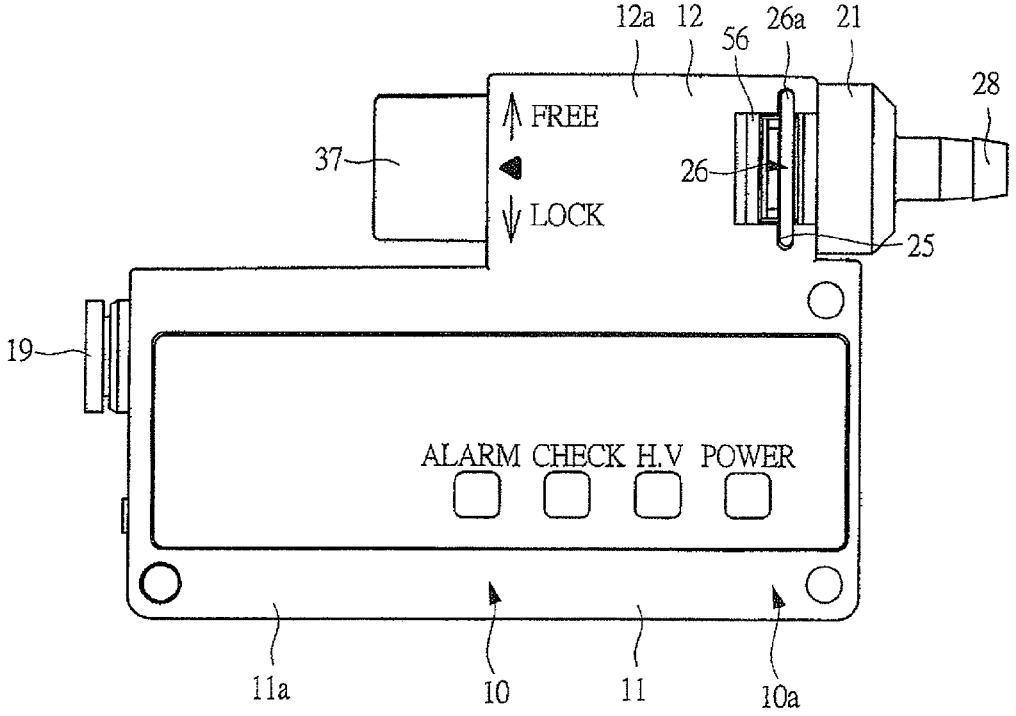
FIG. 2 is a side view of FIG. 1.

The air introduction hole 56 is formed also in the outer case 10*a* within the ion generator shown in FIG. 2, and as shown in FIG. 8, the communication hole 57 and the filter chamber 58 are formed also in the support block 16. Accordingly, as shown in FIG. 8, when the discharge needle unit 31 without the suction port 55 is mounted in the device main body 10, air is not sucked in and supplied to an interior of the discharge needle unit from the air introduction hole 56 shown in FIG. 2. Thus, without changing a structure of the device main body 10, the form of the ion generator can be set to both of a constitution in which the discharge needle unit 31 shown in FIG. 8 is mounted, and a constitution in which the discharge needle unit 31*a* shown in FIG. 12 is mounted.

The form of a tip portion of the opposite electrode 21*a* shown in FIGS. 11 and 12 is different from that of the opposite electrode 21 described in the above-mentioned embodiment, and is not provided with the small-diameter portion 28. Accordingly, the ionized air sprayed from the opposite electrode 21*a* is sprayed directly onto the charged member from the opposite electrode 21*a*. Thus, if the respective back end portions in the opposite electrode 21 having the form shown in FIG. 8 and in the opposite electrode 21*a* having the form shown in FIG. 12 are set to have the same size in dimension, they can be selectively mounted in the support block 16.

Figure 13:
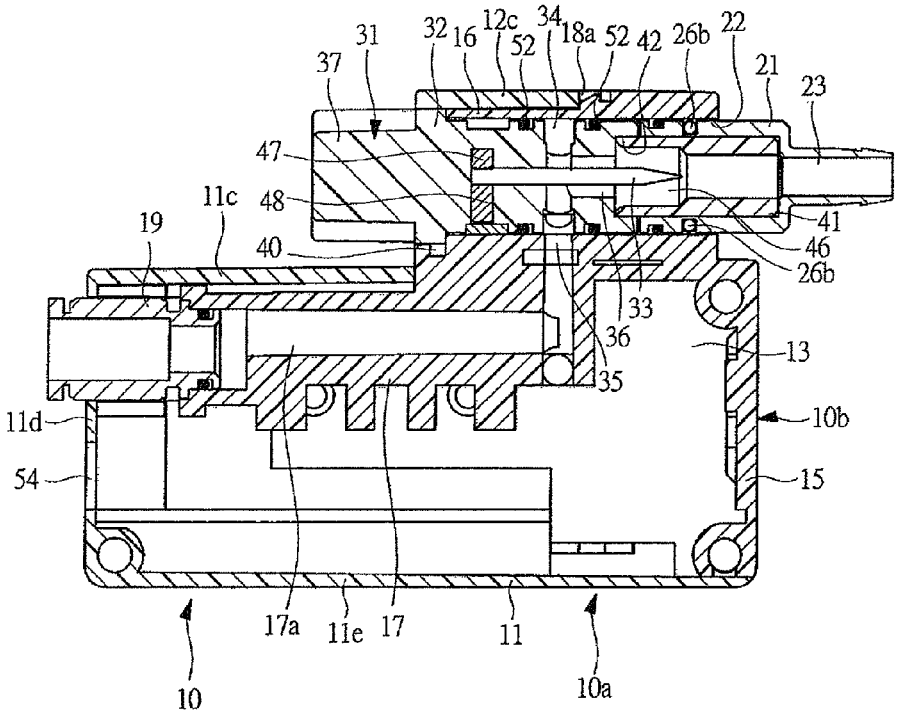
FIG. 13 is a sectional view showing a portion similar to that of FIG. 10 in an ion generator according to still another embodiment of the present invention.

FIG. 13 is a sectional view of an ion generator according to still another embodiment of the present invention. In FIG. 13, a section similar to that shown in FIG. 10 which is the above-mentioned embodiment is illustrated, and the same reference numerals are denoted to ones among members shown in FIG. 13, which are common to those shown in FIG. 10.

The fitting hole 22, formed in the inner case 10*b* within the device main body 10 in the present embodiment, has the same diameter as a whole. Accordingly, in the ion generator of the present embodiment, the opposite electrode 21 can be attached and detached also to and from any one direction of front and back sides. The sleeve 41 is fitted in the fitting hole 42 of the holder 32, and the opposite electrode 21 is fitted outside the sleeve 41, whereby fitting strength of the sleeve 41 with respect to the fitting hole 42 becomes larger than that of the opposite electrode 21 with respect to the sleeve 41.

In the ion generator shown in FIG. 13, when the discharge needle unit 31 is withdrawn and pulled from a back direction of the device main body 10 under a state of attaching the opposite electrode 21 to the support block 16 by the clip pin 26, the sleeve 41 is removed from the device main body 10 along with the holder 32, and the discharge needle unit 31 is separated from the opposite electrode 21. Meanwhile, when the discharge needle unit 31 is withdrawn and pulled from the back direction of the device main body 10 under a state of removing the clip pin 26, the discharge needle unit 31 in a state in which the opposite electrode 21 is combined is removed from the device main body 10. When the opposite electrode 21 is removed from the discharge needle unit 31 that has been removed, the opposite electrode 21 is separated from the discharge needle unit 31.

Figure 14:
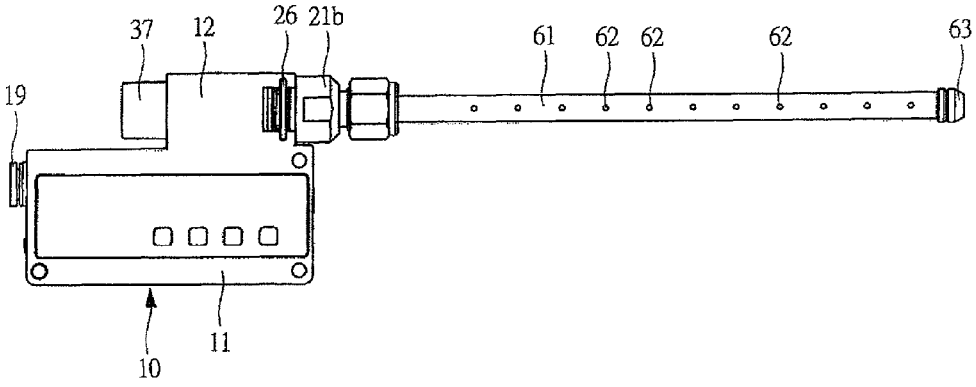
FIG. 14 is a side view showing an ion generator according to another embodiment of the present invention.
Figure 15:
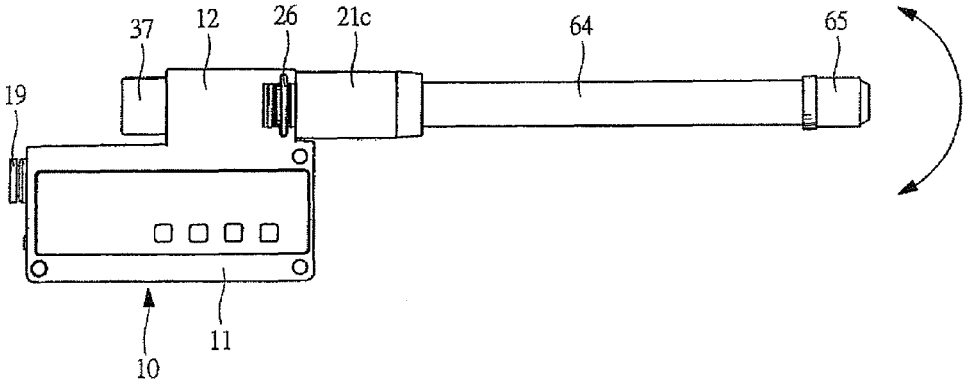
FIG. 15 is a side view showing an ion generator according to another embodiment of the present invention.

FIGS. 14 and 15 are side views each showing an ion generator according to another embodiment of the present invention. A structure of an opposite electrode in each of those ion generators is different from those of the above-mentioned opposite electrodes 21 and 21*a*, but other structures therein are identical to those of the above-mentioned embodiments.

Attached to a tip portion of an opposite electrode 21*b* shown in FIG. 14 is an ion supplying pipe 61. A plurality of ion spraying ports 62 are formed in the ion supplying pipe 61 so as to be spaced at a predetermined interval, and a tip portion of the ion supplying pipe is closed by a cap 63. So as to correspond to the respective ion spraying ports 62 described above, the similar ion spraying ports 62 are formed in the ion supplying pipe 61 also on its opposite side that is shifted a phase of 180 degrees in a circumferential direction, and the ion spraying ports 62 are provided two lines on the ion supplying pipe 61. By using this type of opposite electrode 21*b*, the ionized air can be sprayed inside a container or a pipe. Incidentally, the ion spraying ports 62 may be formed four lines in the circumferential direction per 90 degrees.

Attached to a tip portion of an opposite electrode 21*c* shown in FIG. 15 is a flexible ion guiding pipe 64. The ion guiding pipe 64 can be bent any direction such as a horizontal direction as well as a up-down (vertical) direction as shown by arrows in FIG. 15, and the ionized air, which is sprayed from a spraying port 65 provided at a tip portion of the ion guiding pipe, can be sprayed, without changing a position of the device main body 10, toward the charged member that is located at various directions.

In each of the above-mentioned ion generators, the sleeve 41 is not fixed to the opposite electrode having a function as a nozzle, and the sleeve 41 is mounted in the discharge needle unit 31 in which the discharge electrode 33 is assembled. Therefore, by removing the discharge needle unit 31, the maintenance of the discharge electrode 33 and the sleeve 41 can be done. Meanwhile, since the opposite electrode 21 is separated from the discharge needle unit 31, and becomes detachable with respect to the device main body 10, all of the opposite electrodes with various kinds of forms described above can be selectively mounted in the device main body 10.

For this reason, various kinds of usable patterns can be obtained using the same ion generator.

The present invention is not limited to the above-mentioned embodiments, and may be variously modified within a scope of not departing from the gist of the present invention. For example, if the ion generator has the form in which the discharge needle unit 31, in which the discharge electrode 33 and the sleeve 41 are detachably mounted in the holder 32, is detachably mounted with respect to the device main body, the unit receiving portion 12 and the main body portion 11 may be separated from each other without forming the device main body 10 integrally with the main body portion 11, in which the air supply pipe 17 is assembled, and with the unit receiving portion 12 that protrudes from the main body portion 11. Further, the discharge electrode is not limited to the above-mentioned structure, and can be used also for any size as long as the back end portion of the discharge electrode has the above size that can be mounted in the support block 16.

What is claimed is:

1. An ion generator applying, under a state of causing air to flow in between a discharge electrode and an opposite electrode, an AC high voltage to the discharge electrode and the opposite electrode, and generating a corona discharge to ionize the air, the ion generator comprising:

a device main body, in which the opposite electrode is mounted so as to protrude forward; and a discharge needle unit including a holder and a sleeve, and detachably mounted into the device main body from a back side of the device main body, the discharge electrode being mounted in the holder so as to protrude from one end portion of the holder, and the sleeve being detachably mounted into one end portion of the holder, being fitted in the opposite electrode, and forming an ion generating space between the discharge electrode and the sleeve, wherein the discharge electrode and the sleeve are detachable from the holder under a state of removing the discharge needle unit from the device main body.

2. The ion generator according to claim 1, wherein the opposite electrode is detachably mounted from a front side of the device main body.

3. The ion generator according to claim 2, further comprising a clip pin, which is detachably mounted in the device main body, and is engaged with an engaging groove formed in an outer circumferential surface of the opposite electrode.

4. The ion generator according to claim 1, wherein an outer circumferential surface of the holder is provided with an engagement protrusion, and the device main body is provided with an inserting groove, into which the engagement protrusion is inserted, and an engaging groove, which communicates with the inserting groove and in which the engagement protrusion enters by rotating the holder.

5. The ion generator according to claim 1, wherein an outer circumferential surface of the sleeve is provided with an engagement protrusion, and the holder is provided with an inserting groove, into which the engagement protrusion is inserted, and an engaging groove, which communicates with the inserting groove and in which the engagement protrusion enters by rotating the sleeve.

6. The ion generator according to claim 1, wherein a communication hole, which communicates with an outside, is formed in the device main body, and a suction port, which sucks exterior air by air sprayed to the ion generating space, is formed in the holder so as to communicate with the communication hole.

7. The ion generator according to claim 1, wherein the device main body comprises:

an inner case provided with a support block, which supports the discharge needle unit, and with an air supply pipe, which supplies air to the ion generating space from an outside; and an outer case provided with a main body portion, into which the air supply pipe is incorporated, and with a unit receiving portion, which is provided so as to protrude from the main body portion and in which the support block is incorporated.

* * * * *